United States Patent [19]

Stoyel

[11] 4,118,956

[45] Oct. 10, 1978

[54] FABRIC PRINTING MACHINE

[75] Inventor: Nigel John William Stoyel, Longridge, near Preston, England

[73] Assignee: Stalwart Dyeing Company Limited, Clitheroe, England

[21] Appl. No.: 829,252

[22] Filed: Aug. 30, 1977

[30] Foreign Application Priority Data

Sep. 6, 1976 [GB] United Kingdom ..... 36882/76

[51] Int. Cl.[2] ..... D06B 21/00; D06B 23/00

[52] U.S. Cl. ..... 68/5 D; 15/307; 26/91; 26/96; 68/13 R; 68/20; 68/205 R

[58] Field of Search ..... 68/5 D, 5 E, 13 R, 20, 68/205 R; 26/91, 96; 118/34; 15/307

[56] References Cited

U.S. PATENT DOCUMENTS

| | | | |
|---|---|---|---|
| 3,824,814 | 7/1974 | Fleissner | 68/20 X |
| 3,852,980 | 12/1974 | Zimmer | 68/5 D |
| 3,893,246 | 7/1975 | Fleissner | 26/96 X |
| 3,950,132 | 4/1976 | Somers et al. | 68/13 R X |

*Primary Examiner*—Philip R. Coe

*Attorney, Agent, or Firm*—Watson, Cole, Grindle & Watson

[57] ABSTRACT

A fabric printing machine, comprising a printing head, a steamer disposed beyond the printing head, a washer disposed beyond the steamer, a pair of stenter chains operative to engage the edges of the fabric advancing from the printing head and to drive it positively through the steamer, through the washer and past a suction slot disposed beyond a wash tank in the washer, means for adjusting the lateral spacing of the stenter chains to suit the width of the fabric, means for injecting steam into the steamer, and means in the wash tank for circulating water through the fabric.

2 Claims, 7 Drawing Figures

FABRIC PRINTING MACHINE

This invention relates to machines for printing long lengths of fabric of the type comprising a printing head, a steamer beyond the printing head for fixing the dye applied to the fabric by the printing head and a washer beyond the steamer for removing unfixed dye and other impurities from the fabric.

In a machine of this type described in British Specification No. 1395979 the unprinted side of the fabric is supported in the steamer on rollers which assist in feeding the fabric through the machine.

It has been found that when it is desired to print sliver knit fabric, or lighter weight tufted fabric having a dimensionally unstable backing layer, serious difficulties occur in the steamer due to the tendency of the rollers to impart longitudinal stretch to such fabrics with resultant reduction in width, which often amounts to 20–25% and may even reach 50%.

With a view to overcoming this difficulty, the invention provides a fabric printing machine, comprising a printing head, a steamer disposed beyond the printing head, a washer disposed beyond the steamer, a pair of stenter chains operative to engage the edges of the fabric advancing from the printing head and to drive it positively through the steamer, through the washer and past a suction slot disposed beyond a wash tank in the washer, means for adjusting the lateral spacing of the stenter chains to suit the width of the fabric, means for injecting steam into the steamer, and means in the wash tank for circulating water through the fabric.

Figure 1A:
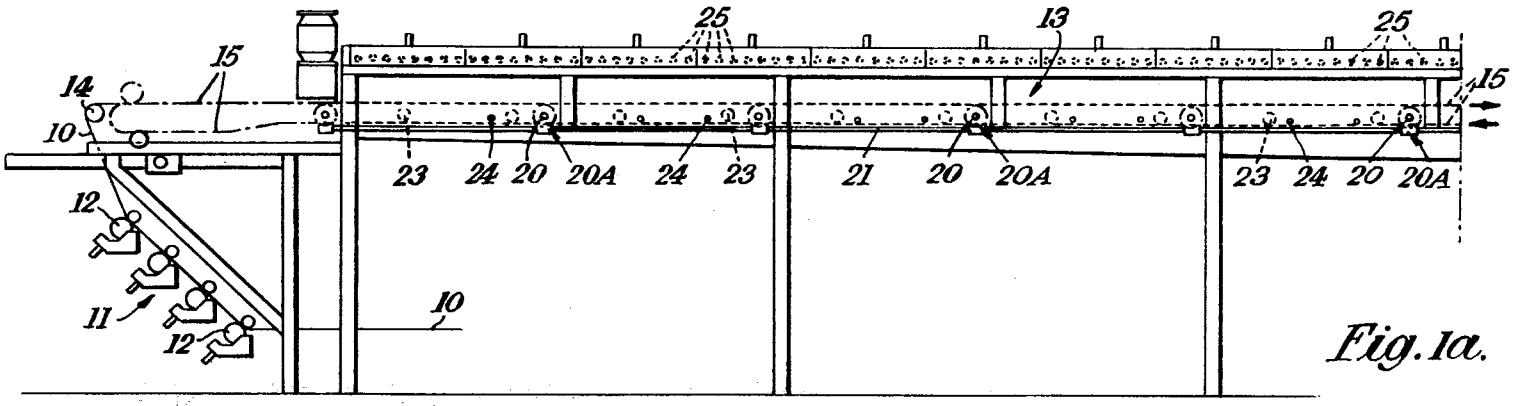
Figure 1B:
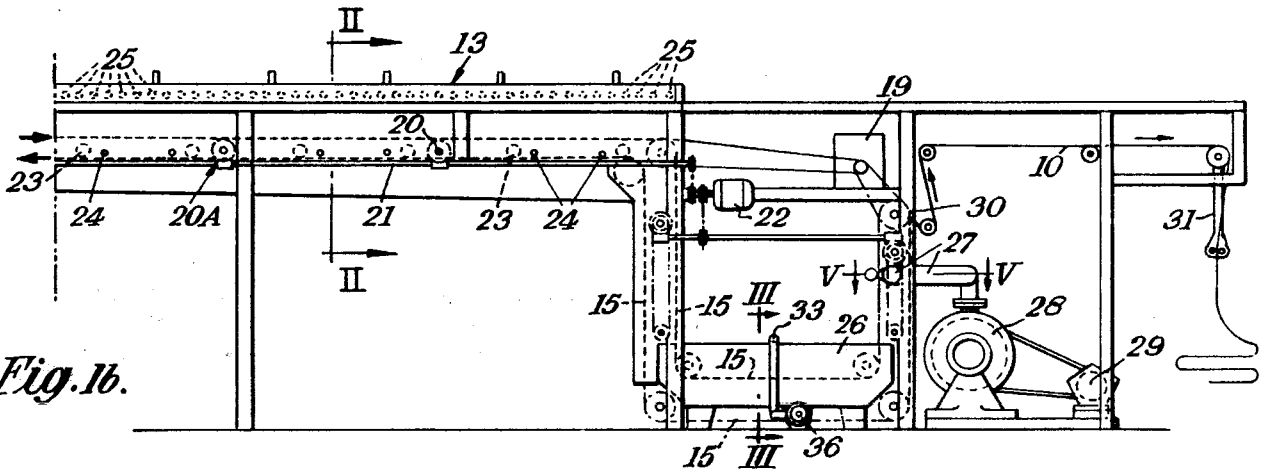
Figure 2:
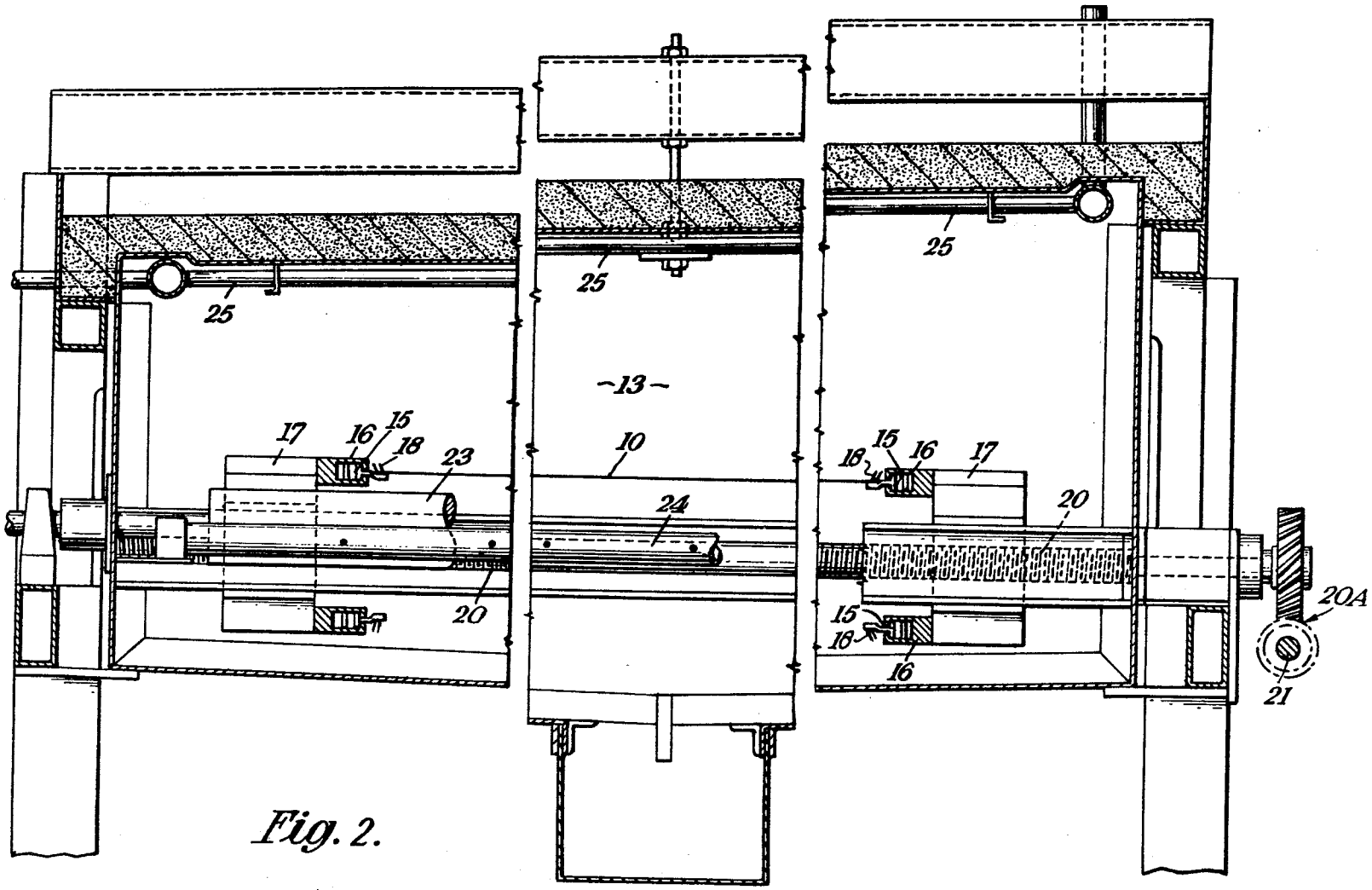
Figure 3:
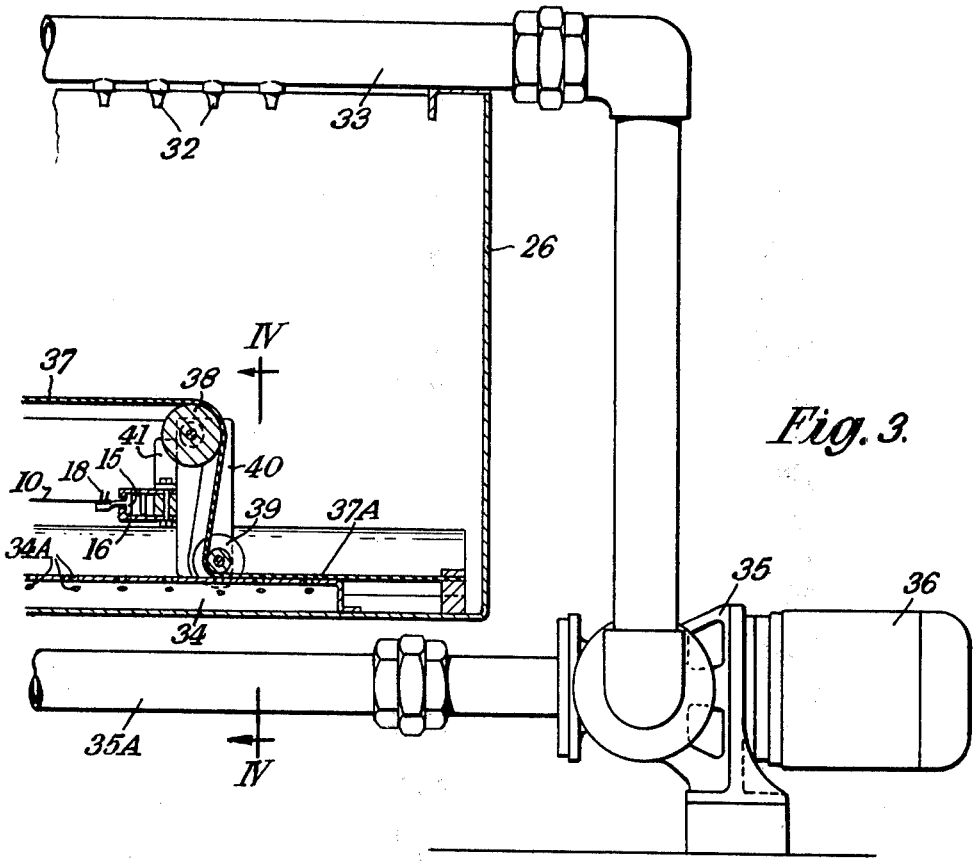
Figure 4:
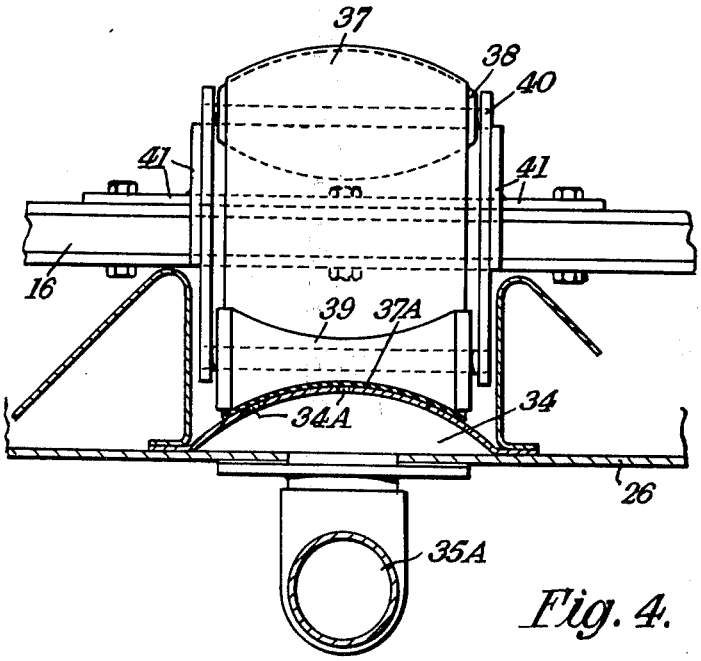
Figure 5:
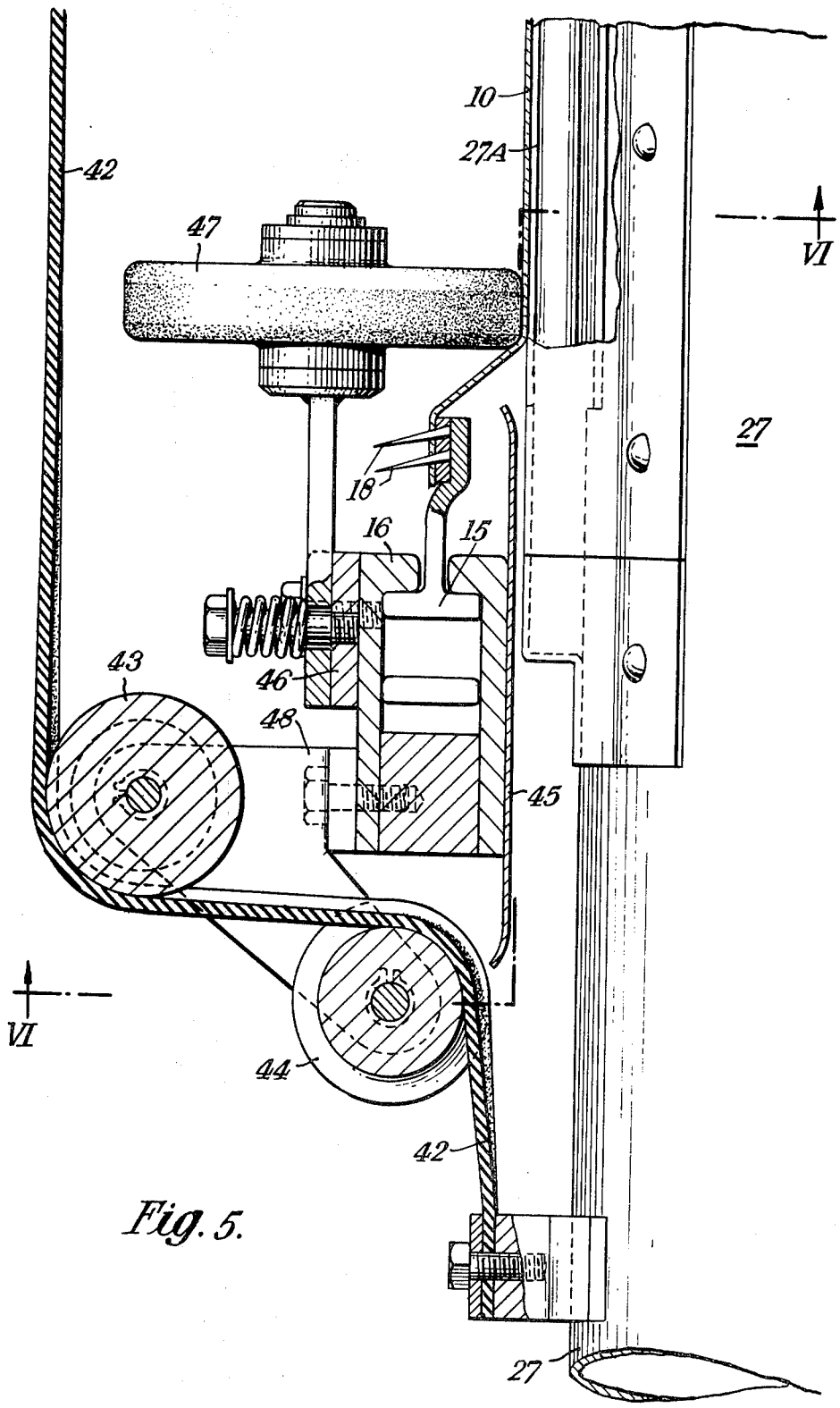
Figure 6:
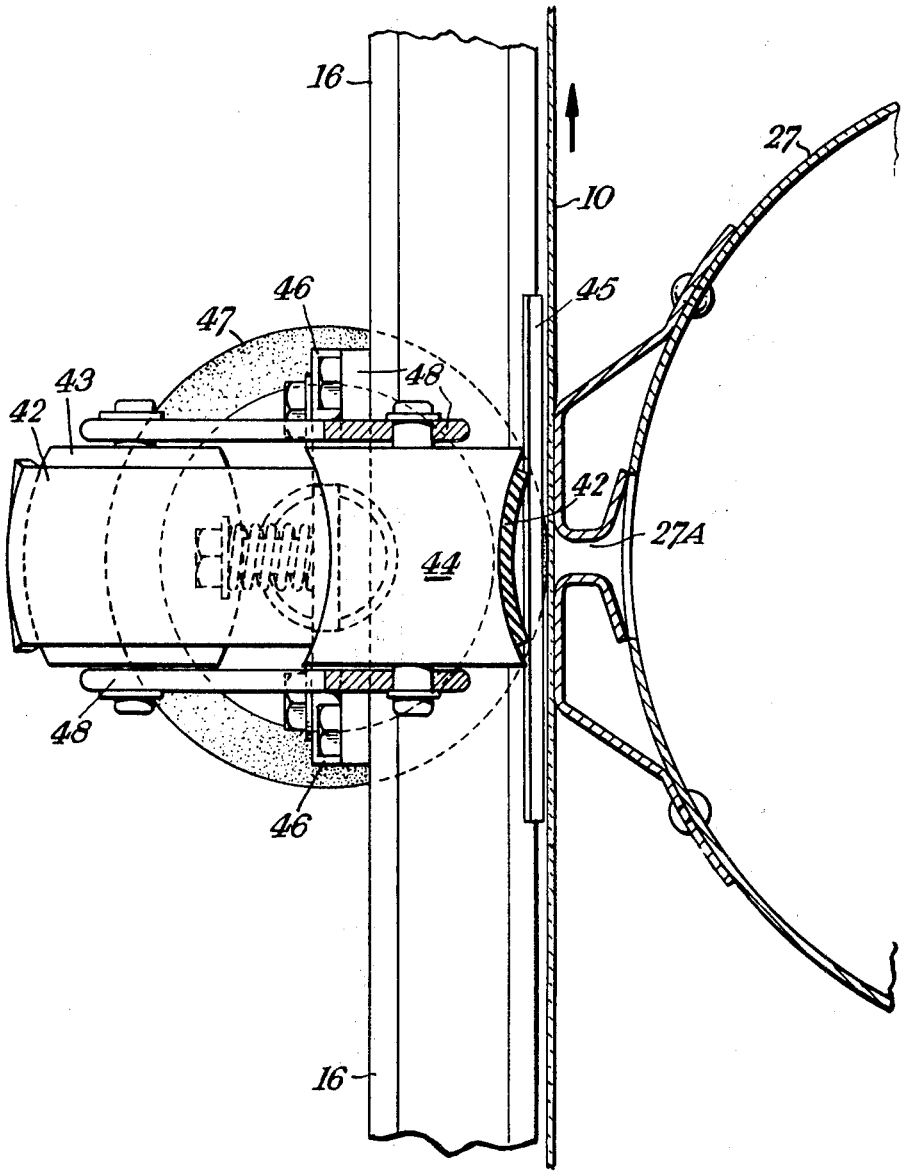

One embodiment of fabric printing unit according to the invention will now be described in detail, by way of example, with reference to the accompanying drawings, in which:

FIGS. 1*a* and 1*b* collectively constitute a diagrammatic side elevation of the machine, FIG. 2 is a section on the line II—II in FIG. 1*b* on a larger scale, FIG. 3 is a part section, also on a larger scale, on the line III—III in FIG. 1*b*, FIG. 4 is a section on the line IV—IV in FIG. 3, FIG. 5 is a section, also on a larger scale, on the line V—V in FIG. 1*B*, and FIG. 6 is a section on the line VI—VI in FIG. 5.

As shown in FIGS. 1*a* and 1*b*, the fabric 10 to be printed travels in an upward direction through a printing head 11, in which printing rollers 12 print the fabric in one or more colours, to the entry of a steamer 13, through which the fabric travels horizontally, as shown.

The fabric 10 enters the steamer 13 by passage around a guide roller 14 which guides it into the horizontal path of travel. It is fed through the steamer by a pair of spaced stenter chains 15 (FIG. 2), which travel in guides 16 supported by slides 17 and carry pins 18 which engage the edges of the fabric. The chains 15 are driven by a drive motor 19 (FIG. 1*B*).

Each slide 17 carries a nut (not shown) which engages a lead screw 20 (FIG. 2). coupled by skew gears 20A to a shaft 21 running along the length of the stenter. The shafts 21 are rotatable, in known manner, by a control unit 22 (FIG. 1*B*) to move the slides 17, and therefore the chains 15, towards and away from one another to suit the width of the fabric 10.

Cloth supporting rollers 23 are provided in the steamer 13 below the level of the fabric 10. These can be used to drive the fabric, if desired, in place of the chains 15 by shifting the chains outwardly to an inoperative position and allowing the fabric to rest on the rollers.

Live steam is injected into the steamer 13 from pipes 24 disposed below the fabric and steam heated coils of pipes 25 are disposed above the fabric.

As it leaves the steamer, the fabric 10 is conducted downwardly by the chains 15 into a wash tank 26, in which it travels horizontally at a level above the bottom of the tank, and then upwardly past a slot 27 A (FIG. 6) in a suction pipe 27, disposed above the liquid level in the tank 26, through which air is sucked by a fan 28, driven by a motor 29 (FIG. 1*B*), to remove excess moisture from the fabric. On leaving the wash tank, the fabric is stripped from the stenter chains 15 at the point 30 and delivered to a lapper 31, which delivers it in lapped formation to a truck (not shown) in which it is conveyed to a final drier.

Water is forced through the fabric in the wash tank 26 from jets 32 (FIG. 3) in a pipe 33 which extends horizontally across the width of the fabric above the fabric and is withdrawn from the tank by a horizontal channel 34 having suction holes 34A and disposed below the fabric, a pump 35, driven by a motor 36, being provided for circulating water between the pipe and the channel, the pump 35 being connected to the channel 34 by a pipe 35A as shown in FIG. 4. A centrifuge (not shown) for removing dirt from the water may be provided in the pump line.

A rubber sealing strip 37 is provided which extends across the tank above the suction channel 34 and passes at each side of the fabric over upper and lower rollers 38, 39 to a part 37A which extends across the top of the channel 34. Each pair of rollers 38, 39 is journalled in a frame 40 (FIGS. 3 and 4) connected by brackets 41 to the chain guides 16. The parts 37A of the strips 37 outside the stenter chains 15 blank off the portion of the suction channel 34 outside the fabric and ensure that the water discharged by the upper pipe 33 will pass through the fabric and cannot bypass it. When the slides 17 are moved inwardly or outwardly to adjust the chains 15 to suit the width of the fabric the lengths of the horizontally extending blanking sections 37A of the strip 37 will change accordingly. In addition, the suction slot 27A (FIG. 6) extends horizontally and transversely to the fabric for the full width of the tank 26. Rubber tyred rollers 47 engage the edge portions of the fabric 10 to press the fabric against the slot 27A just inboard of the chains 15. A rubber belt 42 blanks off the portions of the slot 27A near the sides of the tank. The belt 42 passes near its ends over upper and lower rollers 43, 44 journalled in a frame 48 fixed to the chain guides 16 and plates 45 on the chain guides extend between the horizontal end portions of the belt 42 and the pressure rollers 47 to ensure that the portion of the slot 27A not in contact with the fabric will be blanked off. The pressure rollers 47 are supported by brackets 46 attached to the chain guides 16, so that they will move in or out with them when the chain guides are adjusted to suit the width of the fabric.

The stenter chains 15 are made of stainless steel or other non-corrosive material. Seals may be provided between the underside of the fabric and the suction channel 34 and the wash tank may contain a plurality of such suction channels. If desired the suction channel can extend for the full width of the tank.

What I claim as my invention and desire to secure by Letters Patent is:

1. A fabric printing machine, comprising a printing head, a steamer disposed beyond the printing head, a washer disposed beyond the steamer, said washer including a wash tank and a suction slot disposed beyond said wash tank, a pair of stenter chains operative to engage the edges of fabric advancing from the printing head and to drive it positively through said steamer, through said wash tank and past said suction slot, mountings for said stenter chains, means for adjusting said mountings to suit the lateral spacing of the stenter chains to the width of the fabric, means for injecting steam into the steamer, and means in the wash tank for circulating water through the fabric, said wash tank including a pipe for discharging water downwardly on to the fabric, a channel disposed beneath the path of travel of the fabric and having suction holes, a pump for circulating water between the pipe and the channel, a sealing strip for blanking off the suction holes in said channel outside the fabric, and guides for the sealing strip supported on said mountings and operative to displace the sealing strip, upon adjustment of the lateral spacing of the stenter chains so as to expose only the suction holes located between the stenter chains.

2. A fabric printing machine, comprising a printing head, a steamer disposed beyond the printing head, a washer disposed beyond the steamer, said washer including a wash tank and a suction slot disposed beyond said wash tank, said suction slot being disposed horizontally above the level of said wash tank, a pair of stenter chains operative to engage the edges of fabric advancing from the printing head and to drive it positively through said steamer, through said wash tank and past said suction slot, mountings for said stenter chains, means for adjusting said mountings to suit the lateral spacing of the stenter chains to the width of the fabric, means for injecting steam into the steamer, means in said wash tank for circulating water through said fabric, pressure rollers for pressing the edges of the fabric against said suction slot, a sealing strip for blanking off the portions of the suction slot outside the fabric and guides for the sealing strip supported on said mountings and operative to displace the sealing strip, upon adjustment in the lateral spacing of the stenter chain, so as to expose only the portion of the suction slot located between the stenter chains.

* * * * *